US006279998B1

(12) United States Patent
Chu et al.

(10) Patent No.: US 6,279,998 B1
(45) **Date of Patent: *Aug. 28, 2001**

(54) SEAT MOUNTING MECHANISM

(75) Inventors: Zooey Chu, Grand Rapids, MI (US); Harald Wurl, Kleinsendelbach; Hermann Bock, Pyrbaum, both of (DE)

(73) Assignee: Teknion Furniture Systems, Inc., Downsview (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,098

(22) Filed: Oct. 19, 1998

Related U.S. Application Data

(63) Continuation of application No. 09/092,755, filed on Jun. 5, 1998, now Pat. No. 6,135,556.

(51) Int. Cl.[7] ..... A47C 7/02

(52) U.S. Cl. ..... 297/440.22; 297/452.55; 297/338

(58) Field of Search ..... 297/337, 338, 297/440.2, 440.22, 452.49, 452.5, 452.54, 452.55; 411/508, 509; 248/624

(56) References Cited

U.S. PATENT DOCUMENTS

| | | | | |
|---|---|---|---|---|
| 2,916,084 | | 12/1959 | Bottemiller et al. . | |
| 3,058,778 | * | 10/1962 | Campbell | 297/452.5 X |
| 3,784,148 | | 1/1974 | Hill . | |
| 3,842,709 | * | 10/1974 | Fuqua | 411/508 |
| 3,851,920 | * | 12/1974 | Harris et al. | 297/440.22 X |
| 3,934,315 | * | 1/1976 | Millheiser et al. | 411/508 |
| 4,671,570 | * | 6/1987 | Hockenberry et al. | 297/337 X |
| 5,409,323 | * | 4/1995 | Greene | 297/452.55 X |
| 5,588,165 | * | 12/1996 | Fromme | 297/452.49 X |
| 5,649,783 | * | 7/1997 | Ichikawa et al. | 297/440.22 |
| 5,662,381 | * | 9/1997 | Roossien et al. | 297/440.22 |
| 5,775,860 | * | 7/1998 | Meyer | 411/508 |
| 5,791,850 | * | 8/1998 | Mundt et al. | 411/508 X |
| 5,934,758 | * | 8/1999 | Ritch et al. | 297/452.54 X |

FOREIGN PATENT DOCUMENTS

| | | |
|---|---|---|
| 805679 | 5/1951 | (DE) . |
| 3328801 A1 | 3/1985 | (DE) . |
| 3503897 A1 | 8/1986 | (DE) . |

* cited by examiner

*Primary Examiner*—Anthony D. Barfield
(74) *Attorney, Agent, or Firm*—Michael Best & Friedrich LLC

(57) ABSTRACT

A chair comprises a seat; a support for the seat; and, a plurality of biasing members mounted between the support and the seat, the biasing members, in combination, have a compressive strength sufficiently high to essentially resist static movement of a person while seated in the chair and sufficiently low to cushion dynamic loads applied to the seat when a person sits down quickly in the chair. Alternately the chair comprises a plurality of connecting members extending between the seat and the support, each connecting member having at least one first detent member to lockingly connecting the seat to the support.

17 Claims, 8 Drawing Sheets

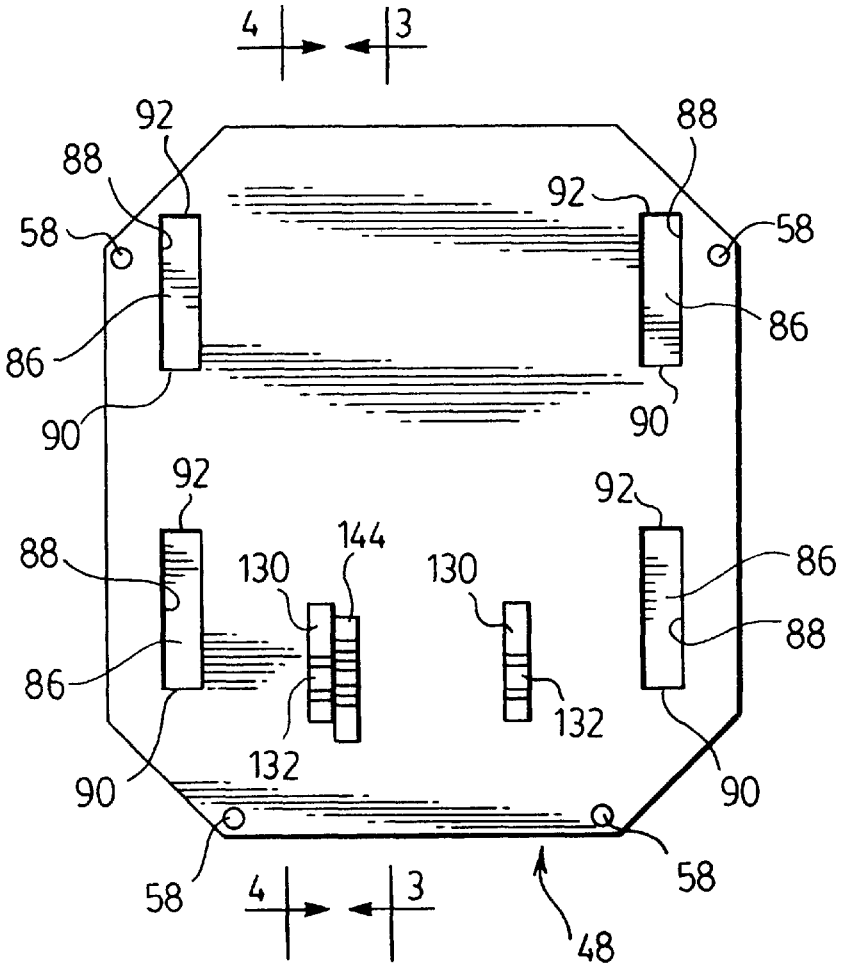
FIG. 2.
FIG. 3.
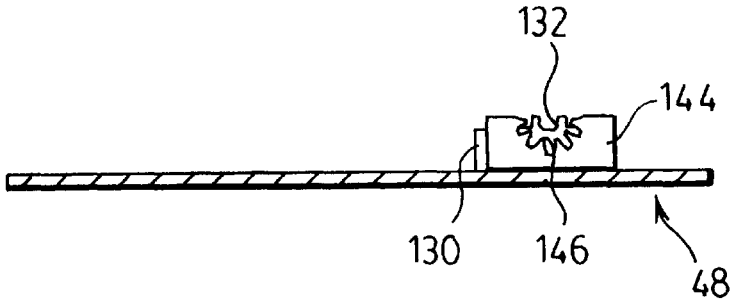
FIG. 4.
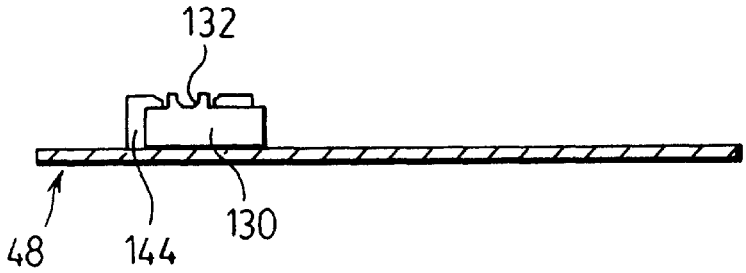

SEAT MOUNTING MECHANISM

This application is a continuation of application Ser. No. 09/092,755 filed on Jun. 5, 1998 now U.S. Pat. No. 6,135, 556.

FIELD OF THE INVENTION

This invention relates to a method and apparatus for mounting a seat on a support. In one embodiment, this invention relates to a mobile chair (e.g. a chair mounted on wheels or a slide base for ease of movement over a surface) and preferably an office chair.

BACKGROUND OF THE INVENTION

Rhyner (U.S. Pat. No. 1,693,120), Kimura (U.S. Pat. No. 4,648,646) and Tamura et al (U.S. Pat. No. 4,796,591) each disclose the use of a rack and pinion to adjust the position of a car seat. Rhyner discloses an adjustment mechanism comprising a hand wheel mounted on a shaft on which pinions are provided. Racks are provided on opposed sides of the bottom of the seat. Upon turning the hand wheel, the pinions rotate causing the cat seat, to which the rack is mounted, to move forwardly or rearwardly. This design is disadvantageous for use with an office chair or the like as it uses two widely spaced apart racks to provide transverse stability to the seat.

Kimura and Timura et al each also disclose the use of spaced apart racks. In addition, these references disclose multiple support and linking members between the seat and the floor of the car. The mechanism discloses a plurality of parts which are complicated to manufacture and are not suitable for use with an office chair or the like.

Ambasz (Canadian Patent No. 1,076,944) discloses a chair which operates on the principle of independent forward and backward movement of the seat and tilting of the back such that a chair may automatically adopt a configuration that will provide excellent anatomical support to a person seated in the chair. To this end, Ambasz discloses a seat which has on its underside, adjacent to the centre and removed from the sides, a pair of elongated sleeves of uniform internal cross-section which extend lengthwise. The sleeves are in telescoping and sliding relation on seat support such that the seat is slidable forwardly and rearwardly. The seat is spring-loaded toward the rearward most position. Accordingly, one disadvantage of this design is that it does not permit the operator to fix the seat in a pre-set position with respect to the chair back.

Matthews et al (U.S. Pat. No. 5,035,466) discloses an ergonomic chair wherein the seat support member is movable between a forward seated position and a rearward seated position. The mounting means for the seat includes a channel having a generally dovetail shaped configuration and a runner having a mating of dovetail shaped configuration that slidable engages the channel. As with Ambasz, the mounting means also includes means for biasing the seat support member toward the rearward position. Thus, the user may selectively apply force while seated in the chair to adjust and retain the position of the seat support member in a desired position between the rearward and forward position of the seat. Upon standing, the user removes the external force from the seat and the contraction force of the biasing means (i.e. A spring) will urge the runner back towards its original rearward seated position. Thus, one disadvantage of Matthews et al is that the chair will not maintain itself in a pre-selected position while the user stands.

Olsen et al (U.S. Pat. No. 5,542,743) discloses a chair in which the seat member is movable with respect to the back-rest of the chair. The adjustment mechanism comprises a pair of parallel spaced tubular members telescopically received in the control bracket. The seat may be fixed in position by a clamping bar which clamps the tubular members to the control bracket. Accordingly, one disadvantage of this design is that, when the clamp is removed, there is no restriction on the movement of this seat with respect to the chair back. Accordingly, the seat would become free floating.

Accordingly, previous disclosures have shown seat adjustment mechanisms for chairs which do not provide adequate controlled adjustment of the position of the seat with respect of the seat support. In addition, prior designs have incorporated constructions which are difficult to employ and/or which are complicated to construct.

SUMMARY OF THE INVENTION

In accordance with the present invention, there is provided a chair comprising a seat; a support for the seat; and, a plurality of biasing members mounted between the support and the seat, the biasing members, in combination, have a compressive strength sufficiently high to essentially resist static movement of a person while seated in the chair and sufficiently low to cushion dynamic loads applied to the seat when a person sits down quickly in the chair The biasing members may deform up to about 0.2 inches. Preferably, the biasing members comprise springs.

In one embodiment, the biasing members are located adjacent the perimeter of the seat. Alternately, or in addition, the biasing members may be positioned adjacent the corners of the seat.

In accordance with another embodiment of the present invention, there is provided a chair comprising a seat having a lower surface; a support for the seat; and, a plurality of connecting members extending between the seat and the support, each connecting member having at least one first detent member to lockingly connecting the seat to the support.

In one embodiment, the connecting members releasably lockingly connect the seat to the support. One of the support and the seat may have a plurality of second detent members configured to lockingly engage one of the first detent members. One of the first and second detent members may be slidably received in the other of the first and second detent members. Alternately, one of the first and second detent members may be resiliently deformable to be received in the other of the first and second detent members. In a further alternate embodiment, one of the first and second detent members has an engagement surface to abut a surface of the other of the first and second detent members. The seat may have a plurality of recesses in the lower surface and each connecting member has a bulbous portion sized to fit within one of the recesses. Alternately, or in addition, the support may have a plurality of recesses and each connecting member has a portion sized to fit and expand within one of the recesses.

In accordance with another embodiment of the present invention, there is provided a chair comprising a seat; a support for the seat; a plurality of individual biasing members positioned between the support and the seat and located adjacent the perimeter of the seat; and, a plurality of connecting members extending between the seat and the support, each connecting member having at least one first detent member to lockingly connecting the seat to the support.

In accordance with another embodiment of the present invention, there is provided a chair comprising a seat; a support for the seat; a plurality of individual biasing means positioned between the support and the seat and located adjacent the perimeter of the seat; and, means for removably connecting the seat to the support.

The means for removably connecting the seat to the support may comprise connecting means having a first end and a second end and extending between the seat and the support, one end of the connecting means having first detent means and one of the seat and the support having second detent means to lockingly connecting the seat to the support.

The biasing members, in combination, may have a compressive strength sufficiently high to essentially resist static movement of a person while seated in the chair and sufficiently low to cushion dynamic loads applied to the seat when a person sits down quickly in the chair.

Preferably the connecting means releasably lockingly connect the seat to the support.

Preferably the chair is an office chair.

One advantage of the instant invention is that it provides a seat which may easily be connected to a support when the chair is being manufactured. Further, the construction of the instant invention allows the seat of the chair to be easily replaced (eg. if it is desired to change the colour of the seat to match the decoration of an office) or if the seat is damaged and needs to be replaced.

A further advantage of the instant invention is that the seat is dampened so as to absorb sudden loading (eg. when a person jumps or flops in to the seat). The seat is dynamically stable during normal use so as to provide a stable seat for a person when seated and working in an office or industrial environment. However, it will move downwardly to absorb dynamic loadings thereby increasing the comfort and durability of the chair.

DESCRIPTION OF THE DRAWINGS

These and other advantages of the instant invention will be more fully and completely understood in association with the following description of the preferred embodiment of the invention in which:

FIG. 2 is a plan view of the interior surface of the cover plate of the housing of the slide mechanism shown in FIG. 1;

FIG. 3 is a cross section of the cover plate along the line 3—3 in FIG. 2;

FIG. 4 is cross section of the cover plate along the line 4—4 in FIG. 2;

DESCRIPTION OF PREFERRED EMBODIMENT

Figure 1:
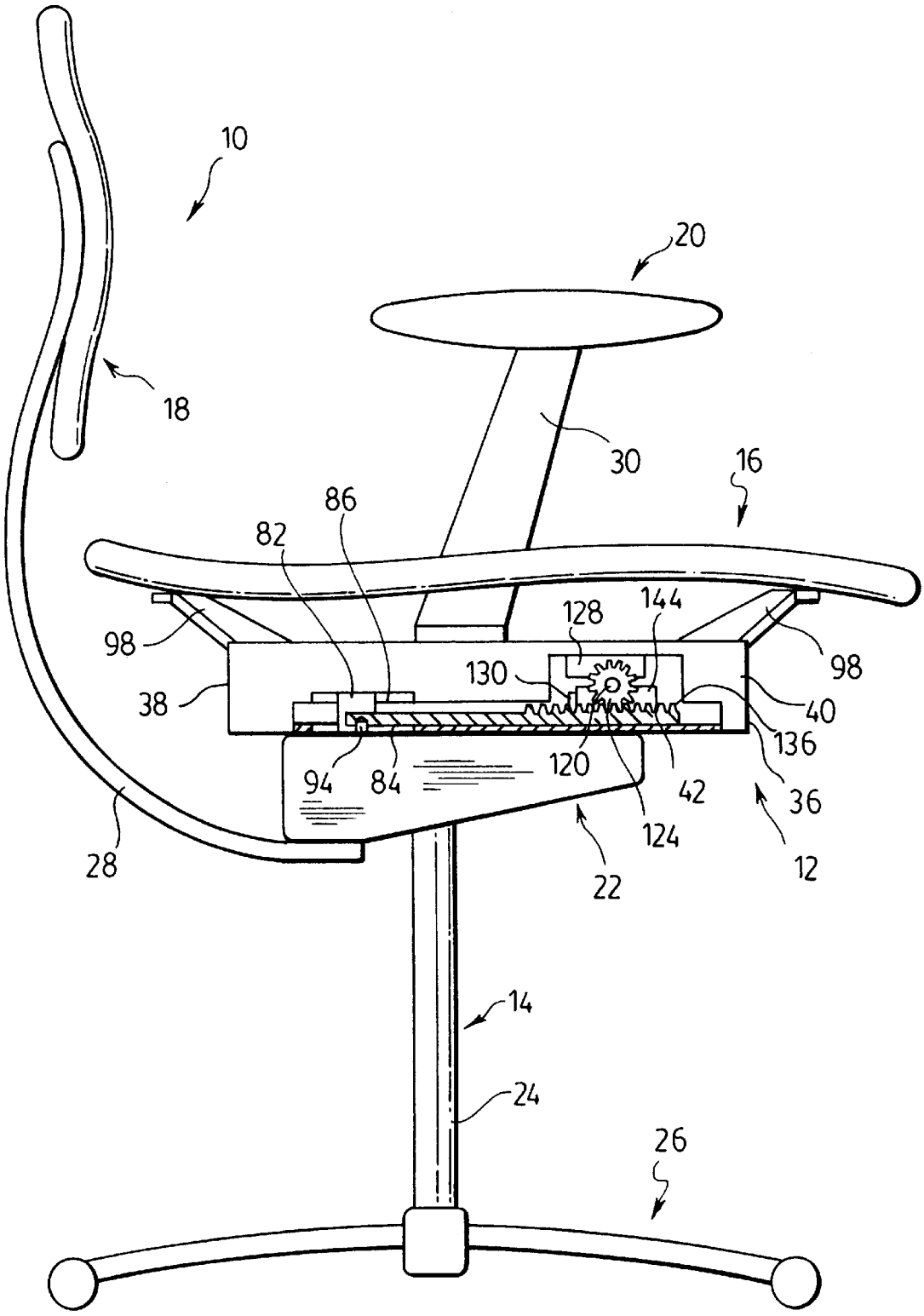
FIG. 1 is a side elevation view of a chair according to the instant invention with the seat adjustment mechanism shown in cross-section along the line 1—1 in FIG. 6.

Referring to FIG. 1, chair 10 comprises a seat adjustment mechanism 12, a support member 14, a seat 16, a back rest 18, arms 20 and tilt mechanism 22.

Chair 10 may be a seating unit of any general type, shape or configuration. As shown in the preferred embodiment, chair 10 is an office chair or a task chair where a person may be seated for an extended period of time while working.

Support member 14 may be any support member for supporting seat 16 at an elevated height. Preferably, support member 14 comprises a longitudinally extending cylinder 24 (which, more preferably, is a pneumatic cylinder) having a wheeled base 26.

Chair 10 may have a back rest 18. Back rest 18 may be of any shape or configuration known in the art. Preferably, back rest 18 is mounted to support member 14 or, as shown in FIG. 1, to tilt mechanism 22 by any means known in the art, such as by means of a curved bracket 28 which is attached by, eg. screws, to the bottom surface of tilt mechanism 22. More preferably, back rest 18 is mounted to tilt mechanism 22. By connecting back rest 18 to a portion of the chair beneath seat adjustment mechanism 12, the position of back rest 18 is affixed to a portion of chair 10 which will remain stationary while the position of seat 16 is adjusted. Therefore, seat 16 may be moved forwardly or rearwardly with respect to back rest 18 by means of seat adjustment mechanism 12. It will be appreciated that bracket 28 may also be affixed to the portion of the seat adjustment mechanism 12 which remains fixed in position with respect to tilt mechanism 22. It will also be appreciated that back rest 18 may have independent controls to adjust, eg., its position with respect to support member 14, its height or its inclination.

Figure 11:
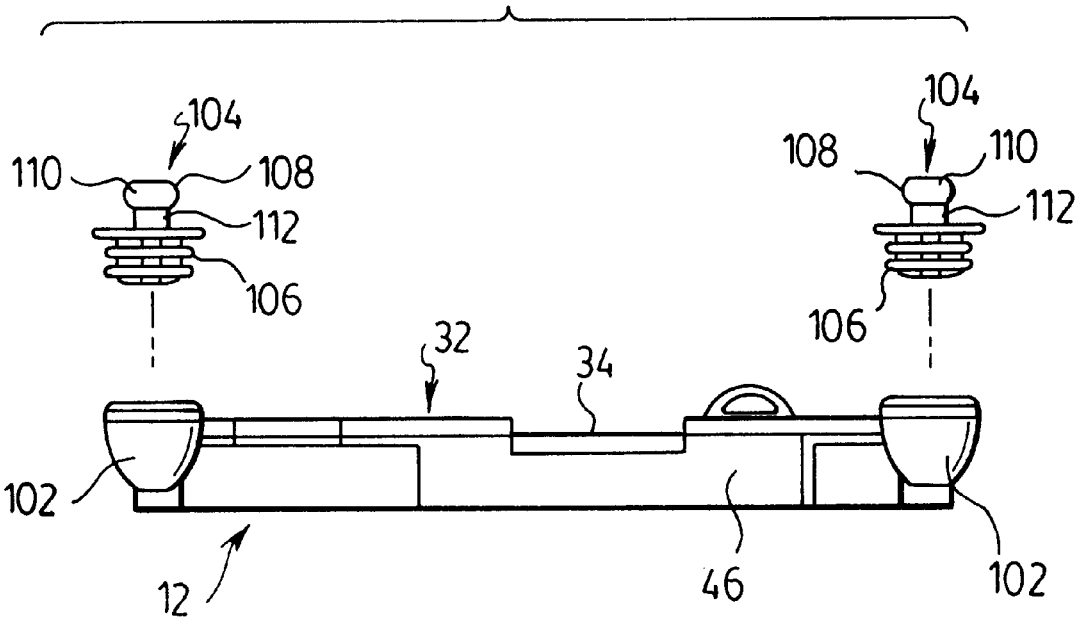
FIG. 11 is a side view of an alternate seat support according to the instant invention.

In a preferred embodiment, chair 10 is also provided with arms 20. Arms 20 may be transversely spaced apart on each side of seat 16. Each arm 20 may be affixed to chair 10 via a bracket 30. Arms 20 may be mounted to chair 10 so as to move with seat 16, in which case bracket 30 may be affixed to the portion of seat adjustment mechanism 12 which moves with seat 16. For example, as shown in FIG. 11, seat adjustment mechanism 12 may have an upper surface 32 which is provided with a recess 34 which is sized and adapted to receive therein and have affixed thereto, the lower portion of bracket 30. Thus, each arm 20 may be affixed to the portion of the seat adjustment mechanism 12 which is stationary with respect to seat 16. Alternately, the lower portion of bracket 30 may be affixed to support member 14, tilt mechanism 22 or the portion of seat adjustment mechanism 12 which is fixed in position with respect to tilt mechanism 22 so that as seat 16 is moved forwardly and rearwardly, the position of arms 20 with respect seat 16 varies.

Seat adjustment mechanism 12 is positioned between support member 14 and seat 16. Preferably, as is known in the art and as is shown in FIG. 1, support member 14 is mounted to a tilt mechanism 22 which may be any mechanism known in the art which will permit seat 16 to rock forwardly or rearwardly. Such tilt/control mechanisms are known in the art and all such mechanisms may be incorporated into chair 10. It will be appreciated that if a tilt mechanism 22 were not provided, support member 14 may be connected directly to seat adjustment mechanism 12 in the same manner as is described for affixing tilt mechanism 22 to seat adjustment mechanism 12.

Seat adjustment mechanism 12 comprises a housing 40 and slide member 42. Housing 40 has a frontward end 36, a rearward end 38 and a cavity for slidably receiving slide member 42. Housing 40 may be of any particular shape and configuration and is preferably of a compact shape which may be unobtrusively positioned beneath seat 16.

Slide member 42 is mounted in housing 40 for longitudinal movement forwardly toward frontward end 36 and rearwardly toward rearward end 38 of housing 40. Further, slide member 42 is mounted in housing 40 so as to be fixed transversely in position with respect to housing 40. Accordingly, as slide member 42 moves longitudinally forwardly or rearwardly with respect to housing 40, it will not move transversely side to side. Seat adjustment mechanism 12 also has an adjustment member 44 mounted in the housing 40 and drivingly connectable to slide member 42.

Figure 5:
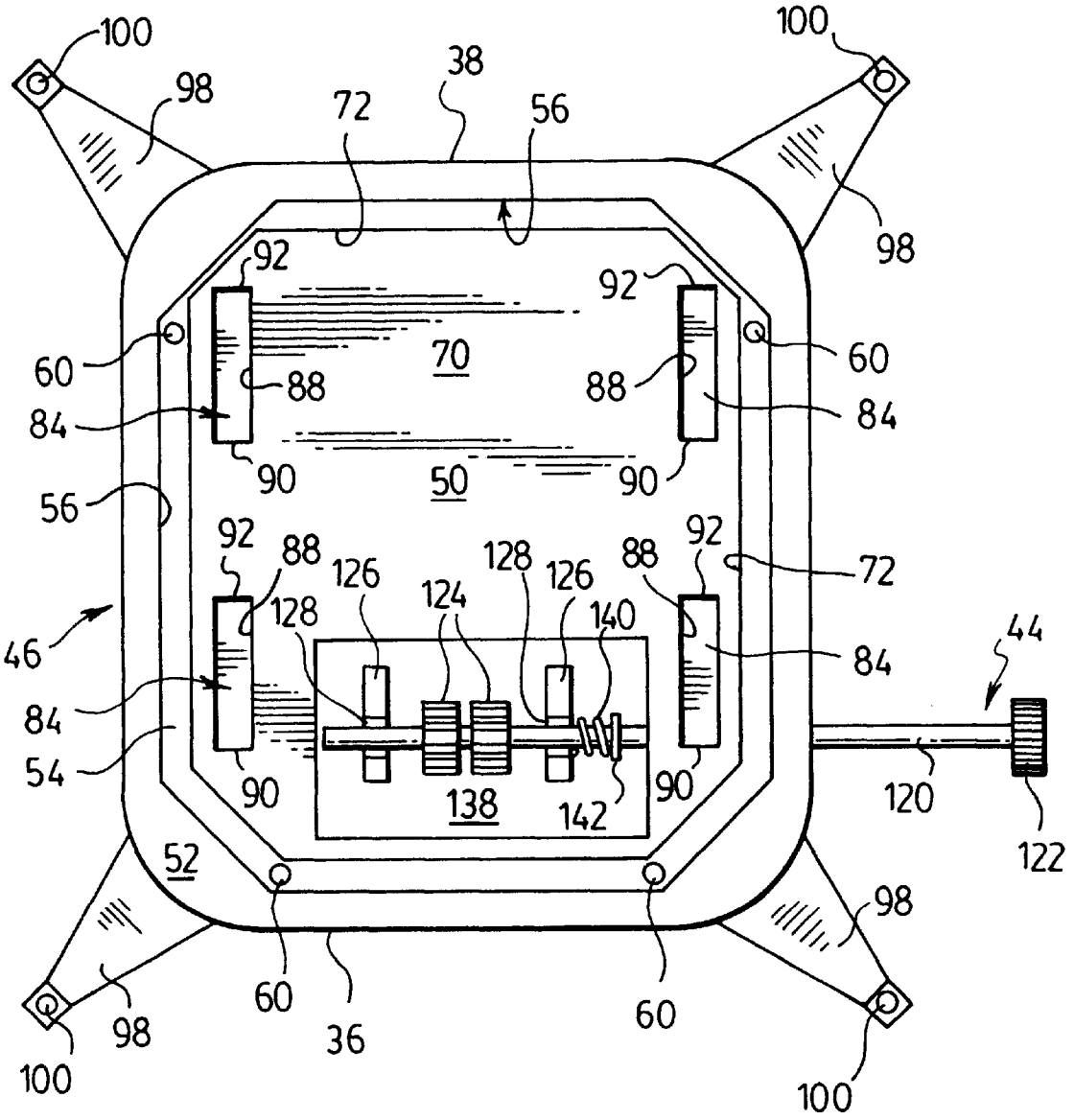
FIG. 5 is a plan view of the interior of the seat support of the seat adjustment mechanism shown in FIG. 1 with the adjustment member mounted therein.

In order to assemble seat adjustment mechanism 12, housing 40 is provided with an access port so that adjustment member 44 and slide member 42 may be mounted therein. Accordingly, in the preferred embodiment, housing 40 comprises seat support 46 and cover plate 48. Pursuant to this construction, seat support 46, when viewed from the bottom in plan view as shown in FIG. 5, has a cavity 50 for receiving slide member 42 (see FIG. 6). Preferably, cover plate 48 is releasably secured to seat support 46.

Housing 40 is configured so that slide member 42 is fixed in position in cavity 50 to slide along tracks which are provided in housing 40. In the preferred embodiment seat support 46 and cover plate 48 are configured so that slide member 42 is sandwiched therebetween to vertically fix slide member 42 in position.

Figure 6:
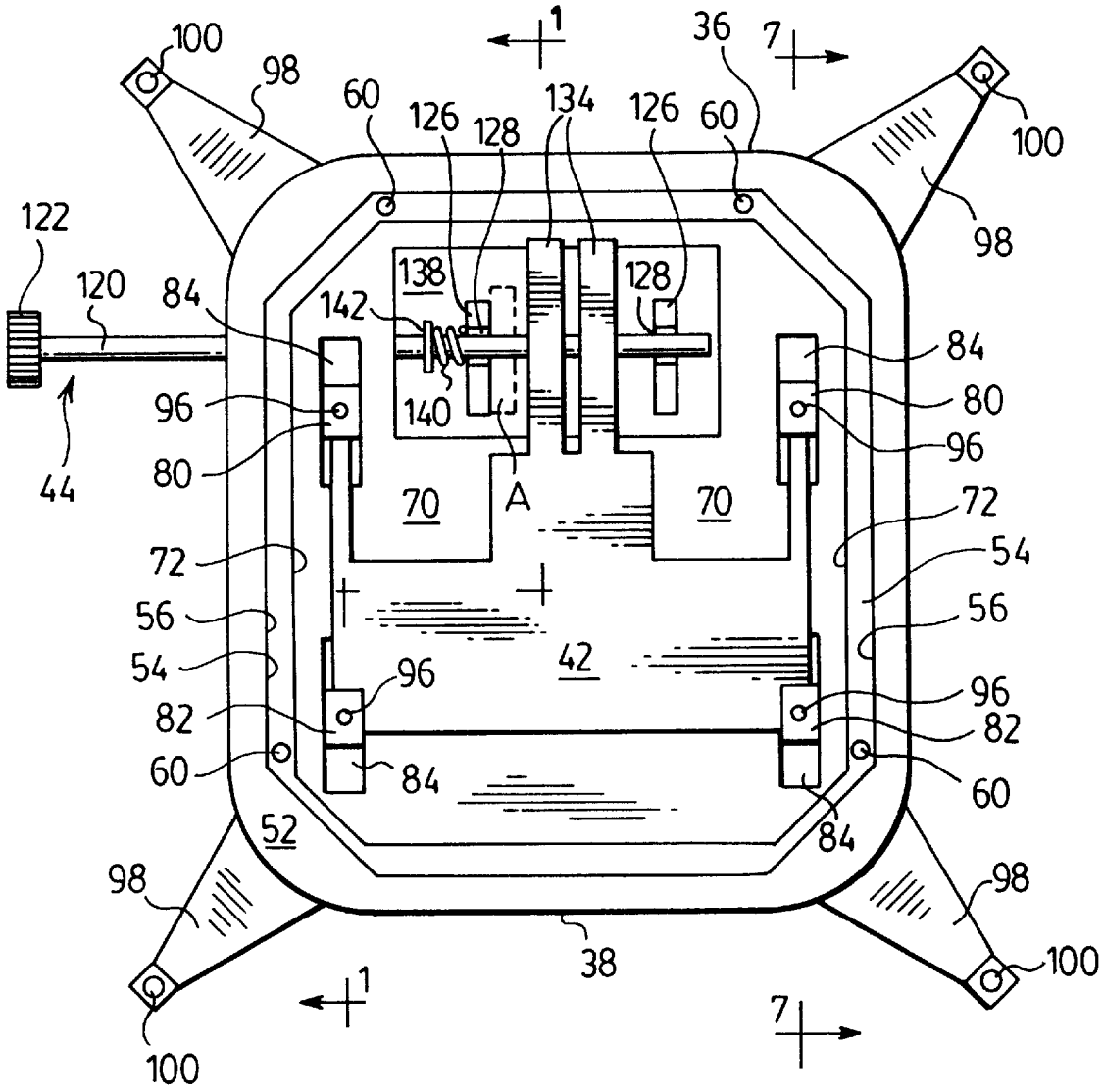
FIG. 6 is a plan view of the interior of the seat support of the seat adjustment mechanism shown in FIG. 1 with the adjustment member and the slide member positioned therein.

Accordingly, as shown in FIGS. 5 and 6, seat support 46 has a bottom surface 52 and a shelf 54 positioned inward thereof to provide an abutment surface on which cover plate 48 may be seated. Shelf 54 is recessed inwardly into seat support 46. Vertically extending side walls 56 extend from bottom surface 52 to shelf 54. Cavity 50 has an inner surface 70 which is recessed with respect to shelf 54. Vertically extending side walls 72 extend from shelf 54 to inner surface 70. The height of vertically extending side walls 72 and vertically extending side walls 56 are selected such that, when slide member 42 is positioned in cavity 50 and cover plate 48 is secured on shelf 54, slide member 42 may move forwardly and rearwardly in cavity 50 with respect to housing 40.

Cover plate 48 may be secured, and preferably releasably secured, in position on shelf 54 by any means known in the art, such as by means of screws (not shown). Accordingly, cover plate 48 may be provided with screw holes 58 and shelf 54 may be provided with mating screw holes 60. Thus, when cover plate 48 is positioned on shelf 54 such that screw holes 58 and 60 align, and screws, or the like, are inserted through screw holes 58 into screw holes 60, cover plate 48 is removably secured to seat support 46 with a cavity 50 extending therebetween.

To mount slide member 42 in housing 40 so that slide member 42 is fixed transversely in position with respect to housing 40, housing 40 may be provided with a path in which slide member 42 moves longitudinally yet restrains transverse side to side motion of slide member 42. For example, the transverse distance between side walls 72 may be slightly larger an the transverse width between side walls 68 of slide member 42 to permit slide member 42 to move longitudinally with respect to side walls 72 but to prevent transverse motion of slide member 42 with respect to housing 40. Alternately, or in addition, housing 40 may be provided with tracks which may have side walls which engage elements of slide member 42 thus preventing transverse motion of slide member 42 with respect to housing 40.

Figure 8:
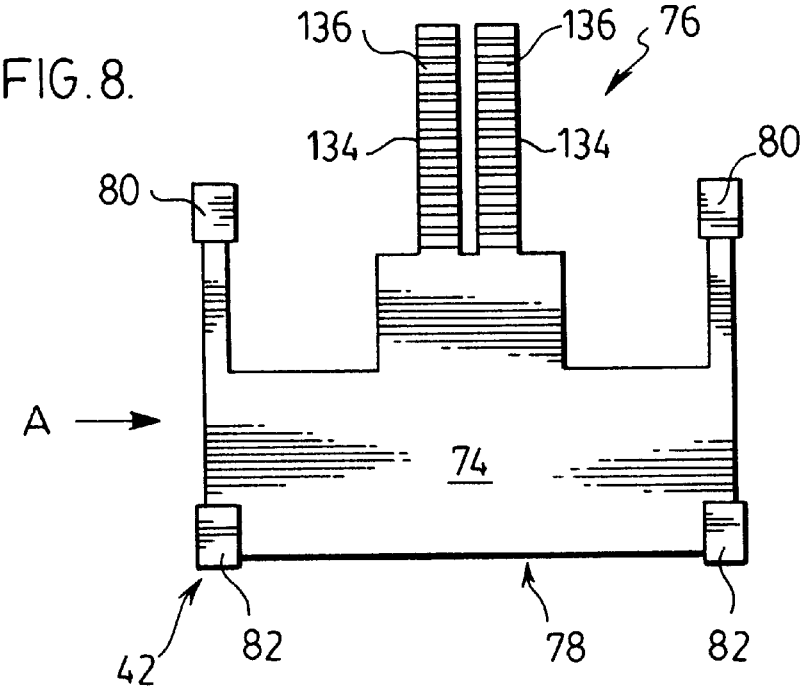
FIG. 8 is a top plan view of the slide member of FIG. 6.
Figure 9:
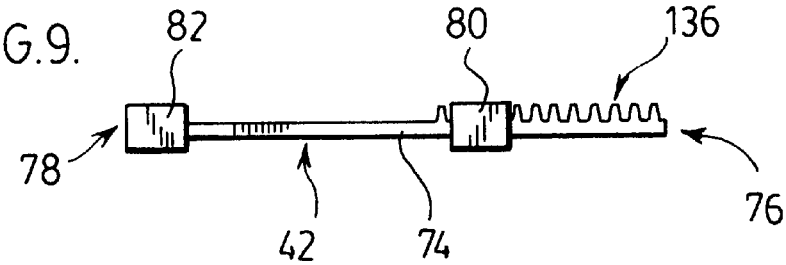
FIG. 9 is a side view of the slide member of FIG. 8 shown in the direction of arrow A of FIG. 8.
Figure 10:
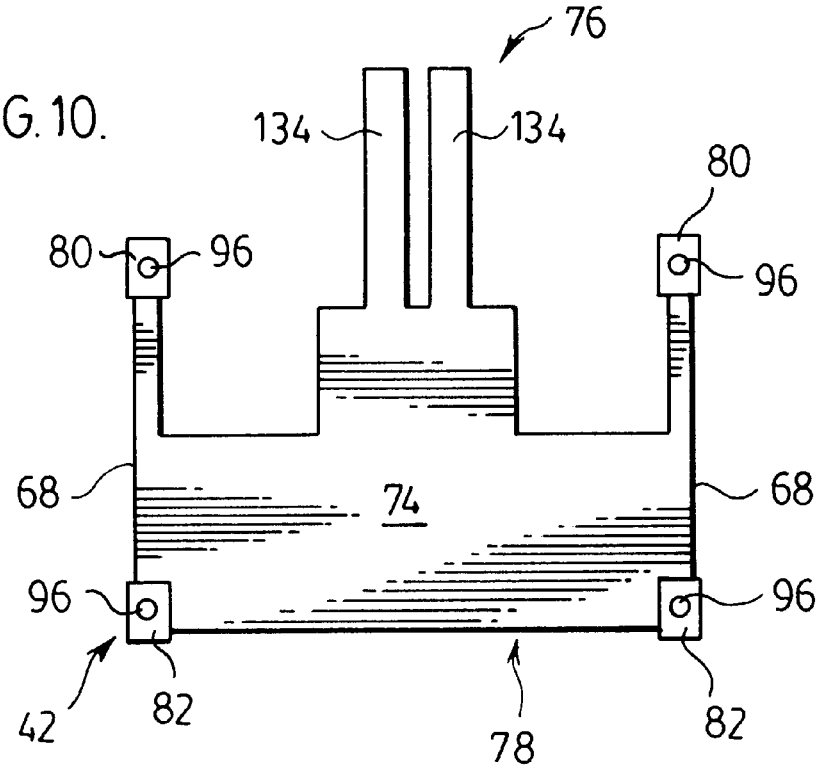
FIG. 10 is a bottom plan view of the slide member of FIG. 6.

Referring to the drawings, in the preferred embodiment, slide member 42 comprises a plate 74 having a forward end 76 and a rearward end 78. Plate 74 is provided with a plurality of slide elements along side walls 68 which enable slide member 42 to slide or glide longitudinally within cavity 50. Referring to FIGS. 8 and 10, slide member 42 may have a plurality of forward slide elements 80 and a plurality of rearward slide elements 82. Preferably, slide member 42 is provided with two forward slide elements 80 which are positioned on opposed transverse sides of plate 74 and two rearward slide elements 82 which are positioned on opposed transverse sides of plate 74. Thus, plate 74 is provided with a pair of forward and rearward slide elements 80 and 82 on each transverse opposed side of plate 74. Plate 74 preferably comprises an integral member which is made from a rigid member such as steel or which may also be made from plastic. Slide elements 80 and 82 may be formed integrally as part of plate 74 or they may be affixed to plate 74 by any means known in the art. In the preferred embodiment, plate 74 and slide elements 80, 82 are a single piece and are made of plastic. Plate 74, as well as pinions 124, may be made by any process known in the plastics industry, such as by moulding. Surprising, despite the forces required to move seat 16 while a person is seated therein, due to the construction of the present invention, a durable and reliable slide mechanism may be obtained even if constructing plate 74, slide elements 80, 82 and pinions 124 from plastic.

Figure 7:
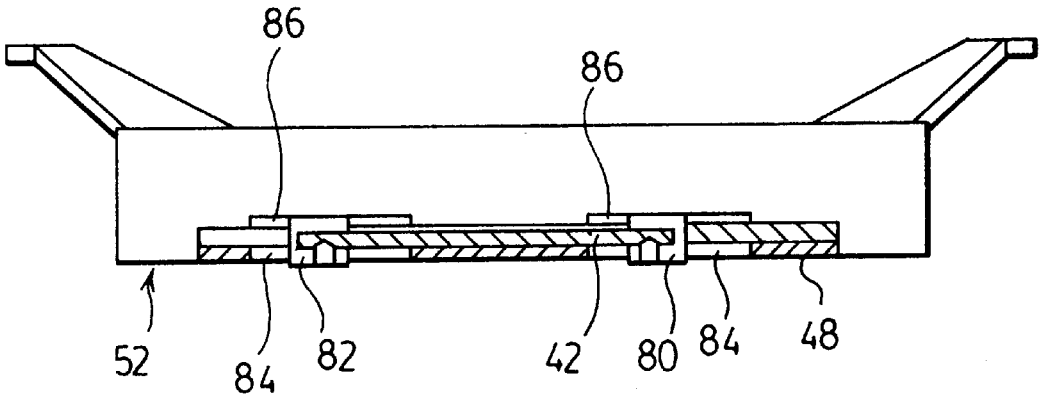
FIG. 7 is a cross section of the seat adjustment mechanism along the lines 7—7 in FIG. 6.

In the preferred embodiment, inner surface 70 is provided with a plurality of grooves 84 for receiving slide elements 80 and 82. Similarly, cover plate 48 is provided with a plurality of grooves 86 which are spaced from, but aligned with grooves 84 of inner surface 70. Accordingly, a pair of groves 84 and 86 is provided for each slide element 80 and 82. Grooves 84 and 86 may be recessed surfaces which have side walls that define a track for slide elements 80, 82. Alternately, grooves 84 and 86 may be on raised platforms which are mounted to inner surface 70 and the inner surface of cover plate 48. Preferably, as shown in FIG. 7, grooves 84 and 86 are openings having side walls 88 in inner surface 70 and cover plate 48 through which slide elements 80 and 82 partially extend. Thus, side walls 88 of grooves 84 and 86 provide abutment surfaces which prevent transverse motion of slide member 42 with respect to housing 40.

As will be appreciated, housing 40 has a pair of rearwardly positioned grooves 84, 86 for receiving rearward slide elements 82 and a pair of forward grooves 84, 86 for receiving forward slide elements 80. Each groove 84, 86 has a forward end 90 and a rearward end 92. Preferably, the longitudinal distance between rearward end 92 of the rearwardly positioned grooves and rearward end 92 of the forward grooves is the same as the longitudinal distance between forward slide elements 80 and rearward slide elements 82. Accordingly, when slide member 42 is in the rearward position in housing 40, each slide element 80, 82 is adjacent the rearward end 92 of the respective grooves 84, 86. Similarly, when slide element 42 is at its forward position in housing 40, each slide element 80, 82 is adjacent forward end 90 of the respective grooves 84, 86.

As will be appreciated, slide member 42 is fixedly mounted to one of seat 16 and tilt mechanisn 22. Accordingly, the housing 40 is mounted to the other of seat 16 and tilt mechanism 22. As shown in FIG. 1, tilt mechanism 22 is fixedly mounted to slide member 42 by means of screws 94. In particular, as shown in FIGS. 6 and 10, each slide element 80, 82 may be provided with a screw hole 96 for receiving a screw 94. It will be appreciated that tilt mechanism 22, or alternately support member 14, may be affixed to slide member 42 by any other securing means known in the art.

Similarly, housing 40 may be affixed to seat 16 by any means known in the art. Preferably, seat support 46 is affixed to seat 16. In the preferred embodiment, seat support 46 is provided with a plurality of arms 98, preferably one at each corner of seat support 46, each of which arm 98 extends outwardly and upwardly. The upper extension of each arm 98 is provided with an opening 100 through which a fastener, such as a screw or the like, may be inserted to affix seat 16 to arms 98.

In an alternate embodiment, as shown in FIG. 11, each arm 98 may have a pod 102 provided at the end thereof. Pod 102 is adapted to receive a spacer 104. Each spacer 104 has an lower portion 106 and an upper portion 108. Spacer 104 may be affixed to pod 102 by any means known in the art. For example, spacer 104 may be provided with a central opening there through which is provided for receiving a fastener (such as a screw or the like). Thus, a screw may be inserted through upper portion 108, through lower portion 106, to be received in pod 102 to thereby affix spacer 104 to pod 102.

Figure 13:
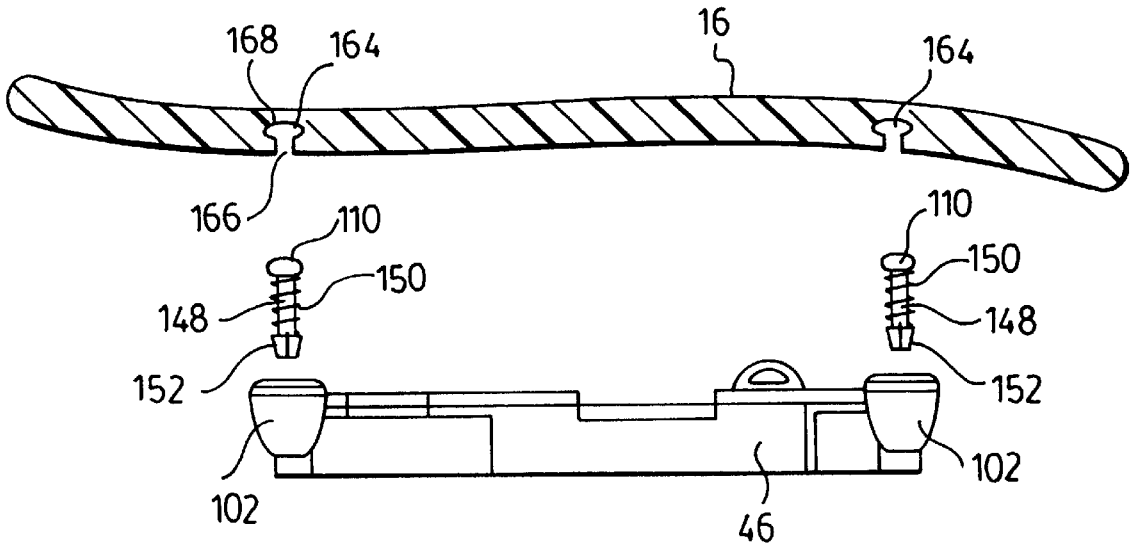
FIG. 13 is an exploded view of the alternative embodiment of the spacer of FIG. 12, with a cross-sectional view of the seat.

Preferably, seat 16 is connected to the chair by a snap type connector and more preferably, seat 16 is removable connected to the chair frame by a snap type connector. Any such connector known in the art may be used. For example, upper portion 108 may have a bulbus portion 110 positioned above a narrower neck 112 comprising a first detent member. The lower surface of seat 16 may be provided with a plurality of openings comprising s second detent member (see for example FIG. 13), each to receive and lockingly engage an upper portion 108 of a spacer 104. The opening in the bottom of seat 16 is preferably sized to be smaller than the diameter of the widest part of bulbus portion 110. Further, bulbous portion 110 preferably is deformable so that it deforms when it is inserted into the opening in the bottom of seat 16. Alternately, or in addition, bulbous portion 110 may have a curved or cam surface on the upper part thereof to assist in inserting bulbous portion 110 into a respective opening in the bottom of seat 16.

The opening in the bottom of seat 16 is configured to lockingly receive bulbous portion 110. For example, each opening may have a first portion 166 that is narrow and a second, inwardly positioned portion 168 that is wider so as to allow bulbus portion 110 to expand at least partially therein. Thus, seat 16 may be affixed to arms 98 by aligning the openings in the bottom of seat 16 with each spacer 104 and pressing downwardly so as to force each bulbus portion 110 to compress and enter into the respective opening, thus snapping seat 16 onto arms 98. If bulbous portion 110 is sufficiently deformable, and/or if the lower surface of bulbous portion 110 has a rounded or cam surface, by applying suitable upward pressure on seat 16, seat 16 may be removed from spacers 104. Accordingly, seat 16 may be removable affixed to the chair frame.

Figure 12:
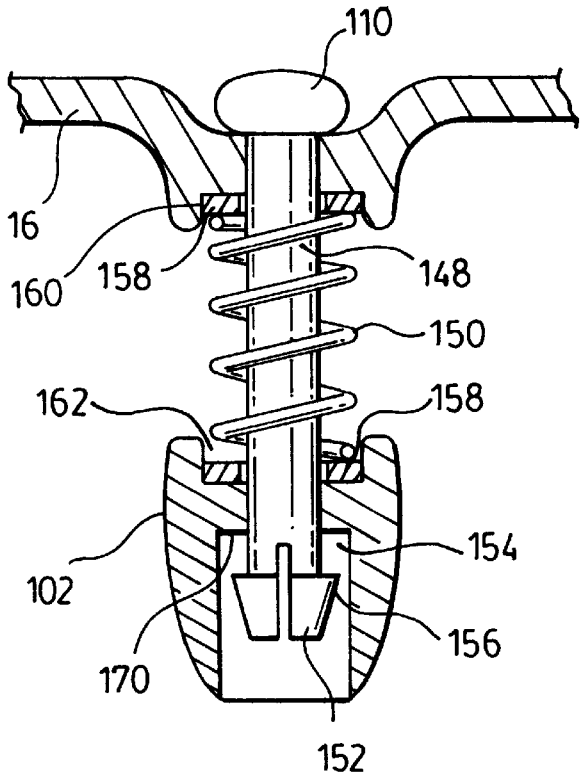
FIG. 12 is a partial cross-sectional view of an alternative embodiment of the spacer of FIG. 11.

Alternately the locking member may be received in pod 102. For example, as shown in FIG. 12, seat 16 may be connected to pod 102 by a connecting pin 148 which extends longitudinally through a spring 150. Connecting pin 148 has a bulbus portion 110, positioned at the top of connecting pin 148. Opposite the bulbous portion 110 is connecting end 152 which is sized to enter chamber 154 in pod 102 through an entrance into chamber 154 which may be only slightly larger than the diameter of connecting pin 148. Pin 148 is retained in pod 102 by engagable detent members. As shown in FIG. 12, shoulder 156 comprises one detent member which expands transversely when inserted into chamber 154 so as to engage with a second detent member, namely upper surface 170 of chamber 154. Adjacent to each end of spring 150 may be provided, eg., steel washers 158, within recessed chambers 160 and 162 respectfully. Steel washers 158 serve to prevent wear to the base of seat 16 or pod 102 by the spring 150. Seat 16 is accordingly secured to seat support 46 by connecting pins 148. Connecting pins 148 are attached to pods 102 by connecting ends 152. Connecting pins 148 are attached to seat 16 by bulbus portions 110 being retained in recess 164. It will be appreciated that in this embodiment, bulbous portion 100 may also be deformable so as to snap into the opening in the lower surface of seat 16.

Alternatively, connecting pin 148 may have a non-deformable cap instead of a bulbus portion 110. In this alternate embodiment, connecting pin 148 would be inserted downwardly through the opening in the bottom of seat 16, eg. from the inner side to the outer side of seat 16, during assembly, thus having connecting pin 148 hang below seat 16. Connection of seat 16 to pods 102 would consist of placing the washers 158 and the spring 150 on connecting pin 148 and inserting each connecting 148 pin into chamber 154.

In an alternative embodiment, seat 16 may be mounted on housing 40 by a plurality of resiliently deformable members which are biased to position seat 16 above housing 40. For example, lower portion 106 may be constructed from a resiliently deformable material, eg. rubber or a synthetic rubber material. The resiliently deformable members are preferably mounted adjacent the perimeter of seat 16 and, more preferably, a resiliently deformable member is positioned adjacent each of the four corners of seat 16 and adjacent the perimeter of seat 16.

Figure 14:
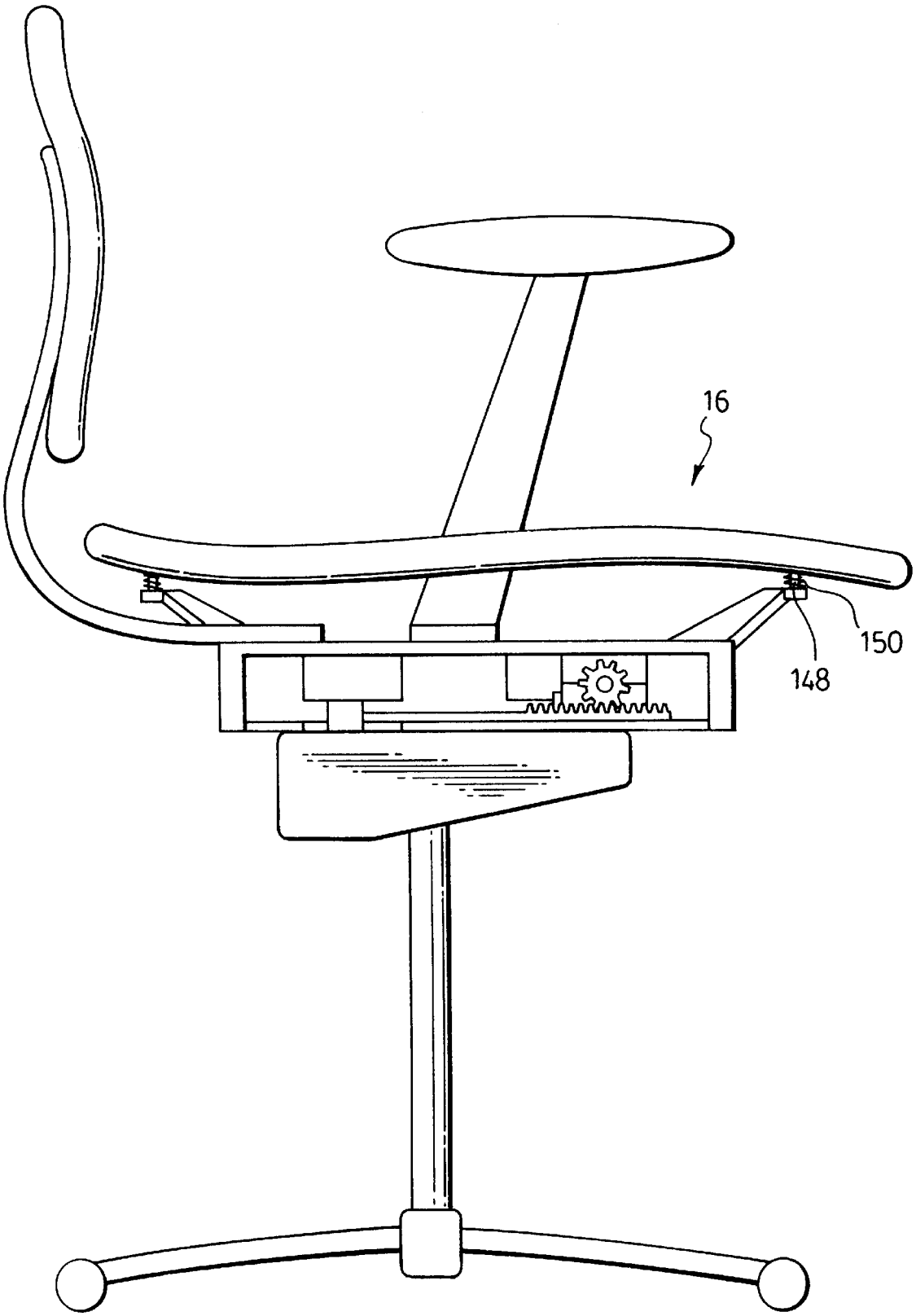
FIG. 14 is a side elevation view of the chair of FIG. 1, with the alternative embodiment of the spacer of FIG. 12.

Alternately as shown in FIG. 12, an alternate biasing member, such as a spring may be used. FIG. 14 is a side elevation view of the chair of FIG. 1, with the alternative embodiment of the spacer of FIG. 12. Springs 150 are preferably of a type known in the art as a "die spring". In the preferred embodiment, springs 150 are chrome silicon SAE 9254, with a spring rate of 550+/−55.0 lb/in, with an internal diameter of ½ inch, an outside diameter of one inch, a free length of one inch, and a solid height of ½ inch. Springs 150 have a sufficient strength to cushion dynamic loads applied to seat 16, i.e. the load applied when the user sits down quickly (eg. plops) into the chair but are sufficiently stiff to resist most static movement, i.e. movements imparted to seat 16 when the user shifts in seat 16. Springs 150 preferably compress a maximum of approximately 0.2 inches when an adult "plops" into the seat 16. Springs 150 preferably do not compress to an extent that the compression is noticeable to the user when the user sits in the chair in the normal manner (i.e. when the user eases themselves into the chair). Accordingly, in combination, springs 150 have a compressive strength sufficiently high to essentially resist static movement of a person while seated in the chair and sufficiently low to cushion dynamic loads applied to the seat when a person sits down quickly in the chair.

As can be appreciated by one skilled in the art, many variations in construction of springs 150 may be utilized to provide the required functionality discussed hereinabove. For example, the springs 150 may be of chrome vanadium, may coil left or right, may be flat or circular in cross section, or may be of different dimensions. The sole requirement being that the springs 150, provide the functionality discussed hereinabove.

It will be appreciated with slide member 42 affixed to tilt mechanism 22 and being movable within housing 40, and with seat 16 mounted to housing 40, seat 16 may move longitudinally (i.e. rearwardly or forwardly) with respect to tilt mechanism 22. Further, by affixing back rest 18 to tilt mechanism 22, as shown in FIG. 1, the position of seat 16 may be moved longitudinally with respect to back rest 18. Since the actual shape of the lower back and upper leg portion of a person varies from individual to individual, the user may adjust the position of seat 16 with respect to back rest 18 to locate an optimal position of seat 16.

In order to assist a person to incrementally adjust the position of seat 16 with respect to back rest 18, and to maintain the respective positions of seat 16 and back rest 18, the chair is provided with adjustment member 44 mounted in housing 40 and drivingly connected to slide member 42 whereby movement of adjustment member 44 in a first direction causes seat 16 to move forwardly and movement of adjustment member 44 in the opposite direction causes seat 16 to move rearwardly. Preferably, adjustment member 44 is rotatably mounted within housing 40 so that the clockwise rotation of adjustment member 44 will move seat 16 in a first longitudinal direction and the counterclockwise location of adjustment member 44 will cause seat 16 to move in the opposite longitudinal direction.

As shown in the drawings, the adjustment member may comprise rack and pinion drive members. In particular, in the preferred embodiment, adjustment member 44 comprises a longitudinally extending shaft 120 which has a control knob 122 positioned at one end thereof and at least one pinion 124 provided adjacent the distal end thereof. Shaft 120 is rotatably mounted in housing 40, for example, by means of upper bearing mount 126 having an upper bearing surface 128 and lower bearing mount 130 having the lower bearing surface 132. When cover plate 48 is mounted to seat support 46, each upper bearing mount 126 is aligned with a respective lower bearing mount 130 such that upper and lower bearing surfaces 128 and 132 provide a support surface along which shaft 120 may rotate.

Plate 74 is provided with a toothed section which is positioned to engage pinions 124. Accordingly, plate 74 may be provided with a rack which is positioned to align with each pinion 124. As shown in FIG. 8, plate 74 has two tongues 134 each of which is provided with a plurality of teeth 136 which are sized and configured to engage the teeth of a respective pinion 124. In order to accommodate pinions 124 in cavity 50, inner surface 70 may be provided with a recessed portion 138 in which upper bearing mounts 126 are affixed. Thus, when slide member 42 is positioned in cavity 50 with slide elements 80, 82 positioned in grooves 84, 86 tongues 134 will overlay pinions 124. Further, when cover plate 48 is affixed to seat support 46, rotation of control knob 122 will cause pinions 124 to drive plate 74 either forwardly or rearwardly.

In order to prevent accidental adjustment of seat adjustment mechanism 12, seat adjustment mechanism 12 may also be provided with a locking mechanism which has a locked position in which adjustment member 44 is fixed in position and an unlocked position in which adjustment member 44 may be moved to adjust the position of seat 16. Preferably, the locking mechanism comprises a biasing member to bias the adjustment member 44 to the locked position. The locking mechanism may comprise a first engagement member which is connected to housing 40 and a second engagement member connect to shaft 120 whereby engagement of the first and the second engagement members prevents adjustment member 44 from being rotated.

Referring to the drawings, adjustment member 44 is provided with biasing member 140. Biasing member 140 is affixed to shaft 120 by any means known in the art. For example, shaft 120 may have a washer 142 or the like affixed thereto and biasing member 140 is preferably a member which may be resiliently withstand a compressive force, such as a spring. Accordingly, when adjustment member 44 is mounted in housing 40, the spring or the like may be compressed between washer 142 and one of the upper bearing mounts 126 by the user pressing control knob 122 in the direction of the longitudinal axis of shaft 120. The compressive force of the spring causes washer 142, and therefore shaft 120 and knob 122 to move to the transverse outward position with respect to housing 40. As shown in FIGS. 5 and 6, an inward force has been applied via control knob 122 to move shaft 120, and therefore pinions 124, transversely inwardly with respect to housing 40.

Cover plate 48 is provided with an abutment member 144 which is positioned and configured to engage a portion of one of the pinions 124 when adjustment member 44 is in the locked position and to be disengaged from pinions 124 when adjustment member 44 is in the unlocked position (as shown in FIG. 5). Preferably, abutment member 144 has a toothed inner surface 146 (see FIG. 3) in which the teeth of pinions 124 may be engaged. It will be apparent that abutment member 144 may be provided on inner surface 70.

Referring to FIG. 6, slide member 42 is shown mounted in seat support 46 with cover plate 48 removed. Tongues 134 extend forwardly over shaft 120. In the unlocked position shown in FIG. 6, tongues 134 are fully aligned with pinions 124 so that pinions 124 are not seen in this bottom plan view. It will be appreciated that if cover plate 48 were affixed to seat support 46, that abutment member 144 would be positioned in the dotted area as shown in FIG. 6 adjacent upper bearing mount 126 and noted as area A. When inward pressure is removed from control knob 122, pinions 124 move outwardly such that at least a portion of one of the pinions 124 engages toothed inner surface 146 of abutment member 144.

In use, the user may be seated in a chair. At that time, the user may reach down and take hold of control knob 122. By pushing inwardly on control knob 122, pinions 124 may be moved inwardly so as to be disengaged from abutment member 144. It will be appreciated that while pinions 124 may partially engage teeth 136 of tongues 134 while still in engagement with the toothed inner surface 146 of abutment member 144, the fact that abutment member 144 is affixed to seat support 46 will prevent the user from being able to rotate control knob 122 and thereby adjust the position of seat 16. By pressing inwardly, pinions 124 are disengaged from abutment member 144 and thus control knob 122 may be freely rotated clockwise or counterclockwise to longitudinally displace slide member 42. As slide member 42 is affixed to tilt mechanism 22, this longitudinal displacement will in fact cause seat 16 to move forwardly or rearwardly.

When the seat is in the desired position, the user merely releases control knob 122. Biasing member 140 causes washer 142 to move outwardly until it engages the side of recessed portion 138. This causes pinions 124 (which are non-rotatably affixed to shaft 120) to move to a position whereby they at least partially engage abutment member 144. Thus, by releasing control knob 122, adjustment member 44 automatically moves to the locked position. Accordingly, it will be appreciated that the locking mechanism of the present invention is easily operable merely by pushing inward on control knob 122 and also by merely releasing control knob 122. Thus, the position of seat 16 may be adjusted while the user is in fact seated in chair 10 as only one hand is required to longitudinally adjust to and lock into, the desired position.

In the preferred embodiment all the components save for the shaft 120, biasing member 140, and spring 150 of the seat adjustment mechanism 12 are made from plastic. The use of plastic for components such as slide member 42 and pinions 124, significantly reduces the cost of manufacture of chair 10.

Although the preferred embodiment utilizes two pinions 124, in an alterative embodiment, a single pinion 124 may be utilized.

We claim:

1. A chair comprising:

(a) a seat having a lower surface;

(b) a support for the seat; and, (c) a plurality of connecting members extending between the seat and the support, each connecting member having at least one first detent member to lockingly connect the seat to the support; and, (d) a plurality of second detent members having an engagement surface to abut a surface of the first detent members, the first detent member comprising spaced apart end members which are resiliently biased to a spaced apart position and which are compressible towards each other to permit slidable insertion into the second detent member and slidable removal from the second detent member.

2. The chair of claim 1 wherein the chair is an office chair.

3. The chair of claim 2 wherein the seat has a plurality of recesses in the lower surface and each connecting member has a bulbous portion sized to fit within one of the recesses.

4. The chair of claim 2 wherein the support has a plurality of recesses and each connecting member has a portion sized to fit and expand within one of the recesses.

5. The chair of claim 1 wherein the connecting members releasably lockingly connect the seat to the support.

6. The chair of claim 1 wherein the first detent member is resiliently deformable so as to be received in the second detent member and detachable from the second detent member.

7. A chair comprising:

(a) a seat;

(b) a support for the seat;

(c) a plurality of individual biasing members positioned between the support and the seat and located adjacent the perimeter of the seat;

(d) a plurality of connecting members extending between the seat and the support, each connecting member having at least one first detent member and one of the support and the seat having a plurality of second detent members, the first detent member comprising spaced apart end members which are resiliently biased to a spaced apart position and which are compressible towards each other to permit slidable insertion into the second detent member;

(e) the biasing members, in combination, having a compressive strength sufficiently high to cushion dynamic loads applied to the seat when a person sits down quickly in the chair.

8. The chair of claim 7 wherein the chair is an office chair.

9. The chair of claim 8 wherein one of the first and second detent members are configured to lockingly engage the other of the first and second detent members.

10. The chair of claim 7 wherein the connecting members releasably lockingly connect the seat to the support.

11. The chair of claim 6 wherein the first detent member is resiliently deformable so as to be inserted into the second detent member.

12. A chair comprising:

(a) a seat in the form of a single continuous member;

(b) a support for the seat;

(c) a plurality of individual biasing means positioned between the support and the seat and located adjacent the perimeter of the seat; and, (d) snap connecting means for removably connecting the seat to the support comprising first detent means and second detent means, the first detent means comprising spaced apart end members which are resiliently biased to a spaced apart position and which are compressible towards each other to permit insertion into the second detent means.

13. The chair of claim 12 wherein the chair is an office chair.

14. The chair of claim 13 wherein the snap connecting means comprises a first end, and a second end and a main body portion extending between the seat and the support, the first end of the connecting means having the first detent means and one of the seat and the support have the second detent means to lockingly connect the seat to the support, the second end being attachable to the other of the seat and the support.

15. The chair of claim 14 wherein the individual biasing means in combination, have a compressive strength sufficiently high to essentially resist static movement of a person while seated in the chair and sufficiently low to cushion dynamic loads applied to the seat when a person sits down quickly in the chair.

16. The chair of claim 15 wherein the snap connecting means releasably lockingly connect the seat to the support.

17. The chair of claim 14 wherein the first detent means is resiliently deformable so as to be inserted into the second detent means.

* * * * *